US006575242B2

(12) United States Patent
Woie

(10) Patent No.: US 6,575,242 B2
(45) Date of Patent: Jun. 10, 2003

(54) METHOD AND AN APPARATUS FOR USE IN PRODUCTION TESTS, TESTING AN EXPECTED PERMEABLE FORMATION

(75) Inventor: Rune Woie, Hafrsfjord (NO)

(73) Assignee: Shore-Tec AS, Hafrsfjord (NO)

( * ) Notice: Subject to any disclaimer, the term of this patent is extended or adjusted under 35 U.S.C. 154(b) by 0 days.

(21) Appl. No.: 09/968,549

(22) Filed: Oct. 2, 2001

(65) Prior Publication Data

US 2002/0017385 A1 Feb. 14, 2002

Related U.S. Application Data

(63) Continuation of application No. 09/403,309, filed as application No. PCT/NO98/00114 on Apr. 6, 1998, now Pat. No. 6,305,470.

(30) Foreign Application Priority Data

Apr. 23, 1997 (NO) ..... 971859

(51) Int. Cl.[7] ..... E21B 47/00; E21B 49/08

(52) U.S. Cl. ..... 166/250.02; 166/66; 166/264; 166/306; 166/250.17

(58) Field of Search ..... 166/250.02, 66, 166/264, 250.17, 306, 100, 250.07; 73/152.29, 152.36

(56) References Cited

U.S. PATENT DOCUMENTS

| | | | |
|---|---|---|---|
| 3,111,169 | A | 11/1963 | Hyde |
| 3,194,312 | A | 7/1965 | Thomas |
| 3,195,633 | A | 7/1965 | Jacob |
| 3,294,170 | A | 12/1966 | Warren et al. |

(List continued on next page.)

FOREIGN PATENT DOCUMENTS

| | | |
|---|---|---|
| EP | 0 022 357 | 1/1981 |
| EP | 0176410 | 4/1986 |
| EP | 0 176 410 | 4/1986 |
| EP | 0 481 866 | 4/1992 |
| EP | 0481866 | 4/1992 |
| EP | 1 041 244 | 10/2000 |
| WO | WO 98/13579 | 4/1998 |
| WO | WO 98/36155 | 8/1998 |
| WO | WO 98/37307 | 8/1998 |
| WO | WO 99/10602 | 4/1999 |
| WO | WO 99/24689 | 5/1999 |
| WO | WO 01/49973 | 7/2001 |

OTHER PUBLICATIONS

Aly, Ahmed; *Characterizing Multi–Layer Reservoirs Using a Fast Simulator and a New Environmentally Sensitive Pre–Production Well Test;* Dissertation, Texas A& M University; Aug. 1995.

Aly Ahmed; *Characterizing Multi–Layered Reservoirs Using a New, Simple, Inexpensive and Environmentally Sensitive Pre–Production Well Test;* SPE 70$^{th}$ Annual Technical Conference and Exhibition, Dallas, Texas, Oct. 22–25, 1995.

(List continued on next page.)

*Primary Examiner*—William Neuder
*Assistant Examiner*—Jennifer R. Dougherty
(74) *Attorney, Agent, or Firm*—Smith, Gambrell & Russell

(57) ABSTRACT

When production testing a permeable first formation, fluid flowing out from the first formation is subjected to a pressure measurement and a flow rate control. In order to avoid bringing up the fluid flowing out during the production test to a surface position, where the fluid's inherent explosion and fire risk as well as poisonousness would cause substantial problems, a fluid flow path is arranged for fluid transfer between the first formation to be production tested and a second permeable formation. The fluid flow path is preferably constituted by a channel-forming pipe. From this channel, the second permeable formation receives the fluid and keeps it for some time. In the position of use, the apparatus is assigned sealing devices such as annulus packers, which are placed such that fluid flow between the formations is limited to only follow the fluid flow path.

74 Claims, 3 Drawing Sheets

U.S. PATENT DOCUMENTS

| | | | | |
|---|---|---|---|---|
| 3,305,014 | A | | 2/1967 | Brieger |
| 3,611,799 | A | | 10/1971 | Davis |
| 3,993,130 | A | | 11/1976 | Papp |
| 4,009,756 | A | | 3/1977 | Zehren |
| 4,296,810 | A | | 10/1981 | Price |
| 4,434,854 | A | | 3/1984 | Vann et al. |
| 4,509,604 | A | | 4/1985 | Upchurch |
| 4,535,843 | A | | 8/1985 | Jageler |
| 4,560,000 | A | | 12/1985 | Upchurch |
| 4,583,595 | A | | 4/1986 | Czernichow et al. |
| 4,597,439 | A | | 7/1986 | Meek |
| 4,633,945 | A | | 1/1987 | Upchurch |
| 4,742,459 | A | | 5/1988 | Lasseter |
| 4,745,802 | A | | 5/1988 | Purfurst |
| 4,766,957 | A | | 8/1988 | McIntyre |
| 4,770,243 | A | | 9/1988 | Fouillout et al. |
| 4,787,447 | A | | 11/1988 | Christensen |
| 4,799,157 | A | | 1/1989 | Kucuk et al. |
| 4,803,873 | A | | 2/1989 | Ehlig-Economides |
| 4,856,585 | A | | 8/1989 | White et al. |
| 4,860,581 | A | | 8/1989 | Zimmerman et al. |
| 5,006,046 | A | | 4/1991 | Buckman et al. |
| 5,065,619 | A | | 11/1991 | Myska |
| 5,170,844 | A | | 12/1992 | George et al. |
| 5,247,829 | A | | 9/1993 | Ehlig-Economides |
| 5,329,811 | A | | 7/1994 | Schultz et al. |
| 5,335,732 | A | * | 8/1994 | McIntyre ..... 166/250.01 |
| 5,337,821 | A | | 8/1994 | Peterson |
| 5,348,420 | A | | 9/1994 | Bernhardt |
| 5,353,870 | A | | 10/1994 | Harris |
| 5,361,839 | A | | 11/1994 | Griffith et al. |
| 5,425,416 | A | | 6/1995 | Hammeke et al. |
| 5,540,280 | A | | 7/1996 | Schultz et al. |
| 5,549,159 | A | | 8/1996 | Shwe et al. |
| 5,551,516 | A | | 9/1996 | Norman et al. |
| 5,555,945 | A | | 9/1996 | Schultz et al. |
| 5,655,605 | A | | 8/1997 | Matthews |
| 5,762,149 | A | | 6/1998 | Donovan et al. |
| 5,799,733 | A | | 9/1998 | Ringgenberg et al. |
| 5,803,186 | A | | 9/1998 | Berger et al. |
| 5,826,662 | A | | 10/1998 | Beck et al. |
| 5,887,652 | A | | 3/1999 | Beck et al. |
| 6,068,053 | A | | 5/2000 | Shaw |
| 6,305,470 | B1 | | 10/2001 | Woie |

OTHER PUBLICATIONS

Aly, Ahmed and Lee, W., John; *Characterizing Multi–Layered Reservoirs Using a New, Simple, Inexpensive and Environmentally Sensitive Pre–Production Well Test;* SPE 36624, SPE Annual Technical Conference and Exhibition, Denver, Colorado; Oct. 5–9, 1996.

Antropov, A.D. and Galiev, N.S. and Elizarov, A.V. and Makismov, V.P., *Results of Testing the Downhole Unit for Water Injection Between Formations on the Trekhozernoe Oilfield;* Gipro Tyumen Nefte Gaz, Oil Producing Department "Shaimneft".

* cited by examiner

METHOD AND AN APPARATUS FOR USE IN PRODUCTION TESTS, TESTING AN EXPECTED PERMEABLE FORMATION

The present application is a continuation of Ser. No. 09/403,309, filed Oct. 20, 1999, now U.S. Pat. No. 6,305, 470, which is a 371 of PCT/NO98/00114, filed Apr. 6, 1998, which prior application is incorporated herein by reference.

FIELD OF THE INVENTION

This invention relates to a method and an apparatus for use in production test of a formation expected to be permeable. After having pointed out the existence of hydrocarbons upon drilling for oil and gas, a so-called production test is carried out, in order to provide information about permeable layers outside the bore hole or well itself.

BACKGROUND OF THE INVENTION

Prior to a production test, when reservoir fluid is allowed to flow out of the formation, the well is provided with some equipment, including means to control the flow rate and measuring equipment to measure pressure and flow rate.

A production test has two phases, each with a duration of e.g. 24 hours. In both phases, a constant fluid flow is established from the formation.

In the beginning, it is fluid in the immediate neighbourhood of the well that flows into the well but, gradually, fluid from areas spaced at constantly larger distances from the well is drained off. The pressure within the well decreases due to the fact that the fluid must flow a constantly longer distance through the formation and, thus, is subjected to a constantly increasing pressure loss. Upon the maintenance of a constant flow rate, it is achieved that the course of pressure within the well only depends on the character of the formation, which can be examined. Therefore, the course of pressure, i.e. interdependent values for pressure and time, is recorded during the production test. In the second phase of the production test, following immediately after the first phase, the fluid flow into the well is stopped.

Then, the pressure within the well will gradually increase to formation pressure as the formation around the well is refilled by means of the fluid flow into the well from remote areas. Also in this second phase, values for pressure and time are recorded.

Recorded pressure—time values in the two phases of the production test represent an important basis for subsequent analyses, appraisals and planning of further drilling activity and, possibly, development of an oil field. The question may well arise as to record other parameters, e.g. temperature, in addition to pressure and it is, of course, important to carry out chemical analyses of samples from the reservoir fluid.

Sealing means, e.g. in the form of annulus packers, are also adapted to take care of security requirements.

The present invention is directed to a method and an apparatus for maintaining a constant flow of reservoir fluid in the well while pressure and, possibly, other parameters are read off.

By a production test it is known to conduct fluid from the reservoir to the surface through a so-called tubing, which is installed in the well. Sealing means are disposed within the annulus between the production tubing and the well wall, preferably on a place where a well casing has been installed, so that reservoir fluid is conducted to the surface through the tubing and not through the annulus. At the upper end thereof, the tubing is assigned a valve adapted to control the fluid flow, and sensors and measuring equipment are disposed, at least for allowing the reading off and recording time, flow rate in the tubing and pressure within the well.

It is known to install a downhole pump in order to achieve and maintain sufficient flow rate to carry out a production test if the pressure within the reservoir or the properties of the formation or reservoir fluid are such that this is required.

Even if the described technique is well developed and has been known for many years, it still suffers from a plurality of disadvantages and deficiencies.

Reservoir fluid constitutes, when it reaches the surface, a safety risk due to danger of explosion, fire hazard and toxicity. Therefore, substantial security measures must be made in connection with a production test. Additionally, reservoir fluid constitutes an environmental problem because production tests naturally are carried out before one takes the costs of installing process equipment. Therefore, it has been customary to conduct reservoir fluid to a burner. Due to the fact that combustion causes unwanted escapes of environmental gases and uncontrolled amounts of hydrocarbons into the sea, there exist some places, such as on the Norwegian continental shelf, where, owing to restrictions on burning and limitation in periods during a year for testing, it has become interesting to collect produced reservoir fluid and convey it to a suitable process plant. Even if this is an environmentally satisfactory solution, it is, nevertheless, awkward, price-raising as well as exhibitting many restrictions both in time and with respect to weather conditions.

The preparations taking place before production testing comprise typically setting and cementing of casings for insulating various permeable layers, and to take care of safety requirements. Additionally, special production tubing is used down to the layer/bed to be tested. These preparations are time-consuming and expensive. Safety considerations make it some times necessary to strengthen an already set well casing, perhaps over the entire or a substantial part of the length of the well; particularly in high pressure wells it might be required to install extra casings in the upper parts of the well.

It can be difficult to secure a good cementing, and it may arise channels, cracks or lack of cement. In many cases, it is difficult to define or measure the quality of the cement or the presence of cement. Unsatisfactory cementing causes great possibility for the occurrence of so-called cross flows to or from other permeable formations outside the casing. Cross flows may, to a high degree, influence the measurements carried out. Time-consuming and very expensive cementing repairs might be required in order to eliminate such sources of errors.

Today's system can take care of drilling of wells in deep waters, but does not provide a safe and secure production testing. In deep water, it is difficult to take care of security in case the drilling vessel drifts out of position, or whenever the riser is subjected to large, uncontrollable and not measurable vibrations or leeway. Such a situation requires a rapid disconnection of the riser or production tubing subsequently to the closing of the production valve at the seabed. To-day's system is defective in respect of reacting on and point out dangerous situations.

Further, in ordinary production it is usual to use various forms of well stimulation. Such stimulation may consist in the addition of chemicals into the formation in order to increase the flow rate. A simple well stimulation consists in subjecting the formation to pressure pulses so that it cracks and, thus, becomes more permeable, so-called "fracturing" of the formation. A side-effect of fracturing can be a large increase in the amount of sand accompanying the reservoir fluid. In connection with production testing, it may in some relations be of interest to be able to effect a well stimulation in order to observe the effect thereof. Again, the case is such that an ordinary production equipment is adapted to avoid, withstand, resist and separate out sand, while corresponding measures are of less importance when carrying out a production test.

In some cases, it would be useful to be able to carry out a reversed production test, pumping produced fluid back into the formation again. However, this presupposes that produced fluid can be kept at approximate reservoir pressure and temperature. This will require extra equipment, and it will be necessary to use additional security measures. Further, it would require transfer of the production tubing. Probably, the production tubing would have to be pulled up and set once more, in order to give access to another formation. This is time-consuming as well as expensive. Therefore, it is not of actual interest to use such reversed production tests in connection with prior art technique. During a reversed production test, a pressure increase is observed in the well while a reversed constant fluid flow is maintained. When the reversed fluid flow is interrupted, a gradual pressure reduction will be observed in the well. Reversed production test may contribute to reveal a possible connection in the rock ground between formations connected by the channel, and may in some cases also contribute to define the distance from the well to such a possible connection between the formations.

SUMMARY OF THE INVENTION

The object of the invention is to provide a method and an apparatus for production testing a well where the described disadvantages of prior art technique have been avoided.

The object is achieved by means of features as defined in the following description and claims.

A main feature of the invention consists in that fluid is conducted from a first, expected permeable formation to a second permeable formation as opposed to prior art technique where fluid is conducted between a formation and the surface. According to the invention, prior to a production test, at least one channel connection is established between two formations, of which one (a first) formation is the one to be production tested. Further, sealing means are disposed to limit the fluid flow to take place only between the formations through the channel connection(s). When fluid flow takes place from first to second formation in an upward direction (the fluid flow may occur in the opposite direction, the formation being production tested then lying above said second, permeable formation accommodating the fluid flow), the sealing means, e.g. annulus packers, prevent fluid from flowing between the formations, outside the channel(s)

Within the channel, flow controlling means are disposed, inclusive a valve and, possibly, a pump, operable from the surface in order to control the fluid flow in the channel and, thus, between the formations. Further, within the channel, a sensor for flow rate in the channel is disposed. This sensor may, possibly, be readable from an surface position.

Additionally, sensors adapted to read pressure, temperature, detect sand, water and the like from the surface may be disposed. Of course, several sensors of each type may be disposed in order to monitor desired parameters at several places within the channel. As previously known, sensors for pressure and temperature are disposed within the well and, moreover, known equipment for timekeeping and recording of measuring values are used.

Upon a production test, by means of the flow rate sensor, the adjustable valve and, possibly, by means of said pump, a constant fluid flow is established and maintained in the channel, fluid flowing from one formation to the other formation. Pressure and, possibly, other well parameters are read and recorded as previously known. Thereafter, the fluid flow is closed, and a pressure built up within the well is monitored and recorded as known. By means of the invention, a production test might be extended to comprise a reversed flow through the utilisation of a reversible pump, so that fluid can be pumped in the opposite direction between the two formations.

Storing produced reservoir fluid in a formation results in the advantage that the fluid may have approximately reservoir conditions when it is conducted back into the reservoir. Further, according to the invention, well stimulating measures in the formation being production tested may be used. Fracturing may be achieved as known per se. To this end, the well is supplied with pressurised liquid, e.g. through a drill string coupled to the channel. Thereafter, a production test is carried out, such as explained. Additionally, a reversed production test may alternately give both injection and production date from two separated layers without having to pull the test string.

BRIEF DESCRIPTION OF THE DRAWINGS

A non-restricting exemplary embodiment of an apparatus for carrying out the invention, is further described in the following, reference being made to the attached drawings, in which.

DETAILED DESCRIPTION OF THE PREFERRED EMBODIMENTS

Figure 1:
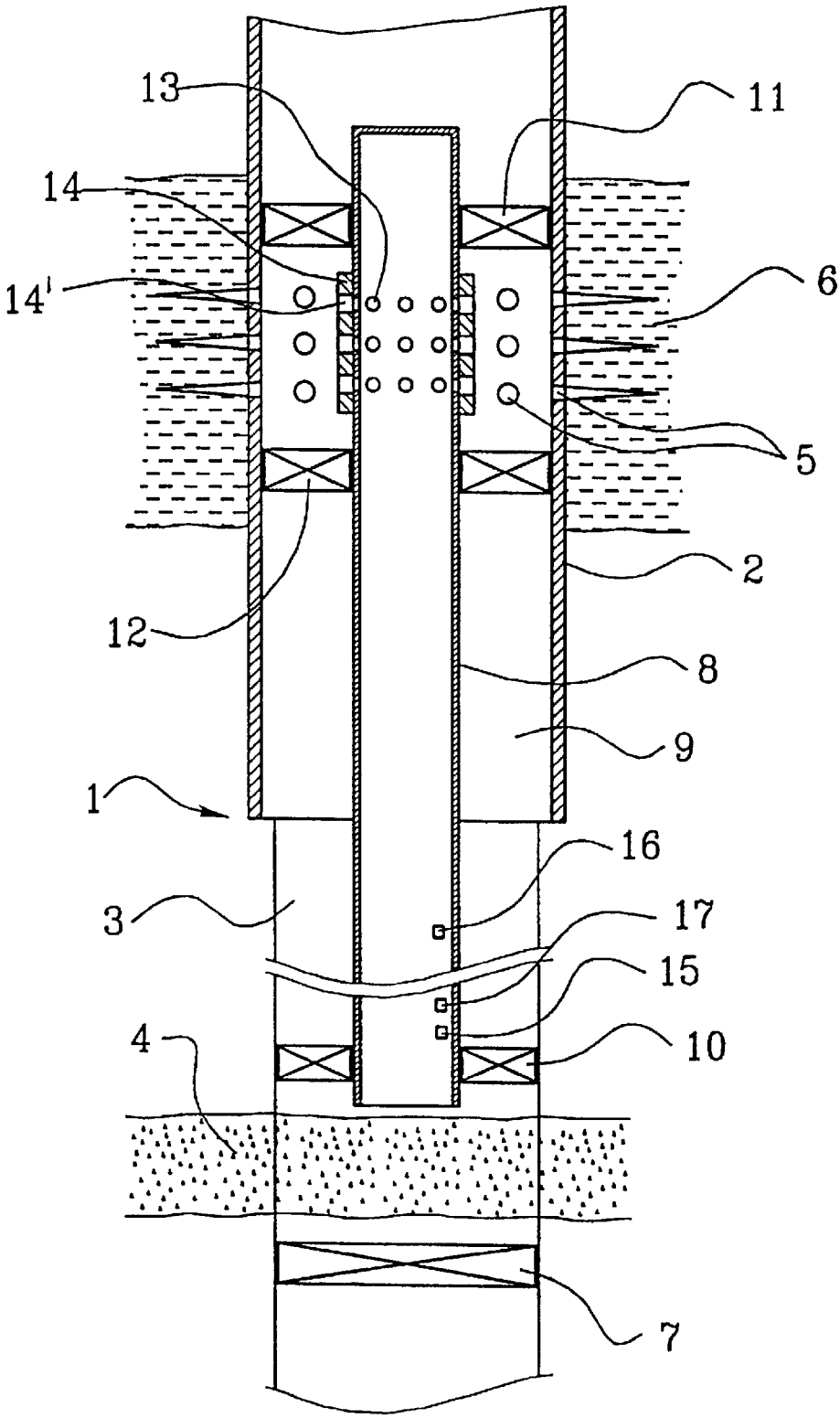
FIG. 1 shows, diagrammatically and in a side elevational view, a part of a principle sketch of a well where a channel has been disposed which connects two permeable formations.

In FIG. 1, reference numeral 1 denotes a part of a vertical well lined with a casing 2. The well 1 is extended with an open (not lined) hole 3 drilled through a first, expected permeable formation 4 to be production tested. The casing 2 is provided with a perforation 5 in an area where the well 1 passes through a second, permeable formation 6.

Figure 1A:
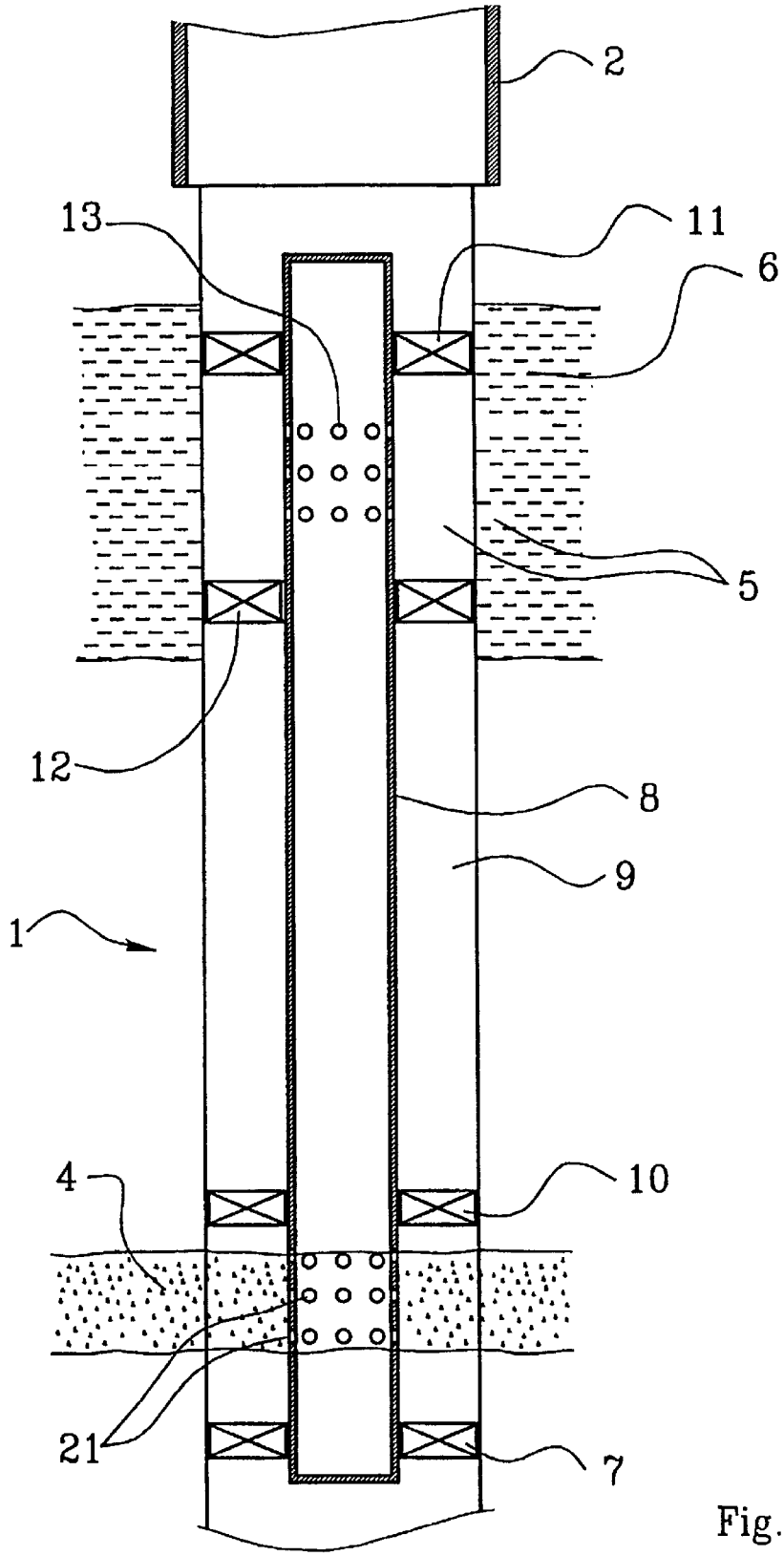
FIG 1*a* corresponds to FIG. 1, but here is shown a minor modification of the channel-forming pipe establishing the fluid flow path between the two formations, the bore hole through said second formation not being lined.

According to FIG 1*a*, second permeable formation 6 is not insulated by means of casings (2 in FIG. 1).

First formation 4 is insulated from possible permeable formations adjacent the bottom of the well by means of a bottom packer 7. A tubular channel 8 extends concentrically with the well 1 from the area at first formation 4 to a place above the perforations 5. Thus, an annulus 9 is formed between the channel 8 and the wall defining the open hole 3 and between the channel 8 and the casing 2.

A lower annular packer 10 placed further from the bottom of the well 1 than first permeable formation 4, defines the lower end of the annulus 9.

An upper annular packer 11 placed further from the bottom of the well 1 than the perforations 5, defines the upper end of the annulus 9.

An intermediate annular packer 12 placed closer to the bottom of the well 1 than the perforations 5, prevents communication between the perforations 5 and possible other permeable formations above the lower packer 10.

Figure 2:
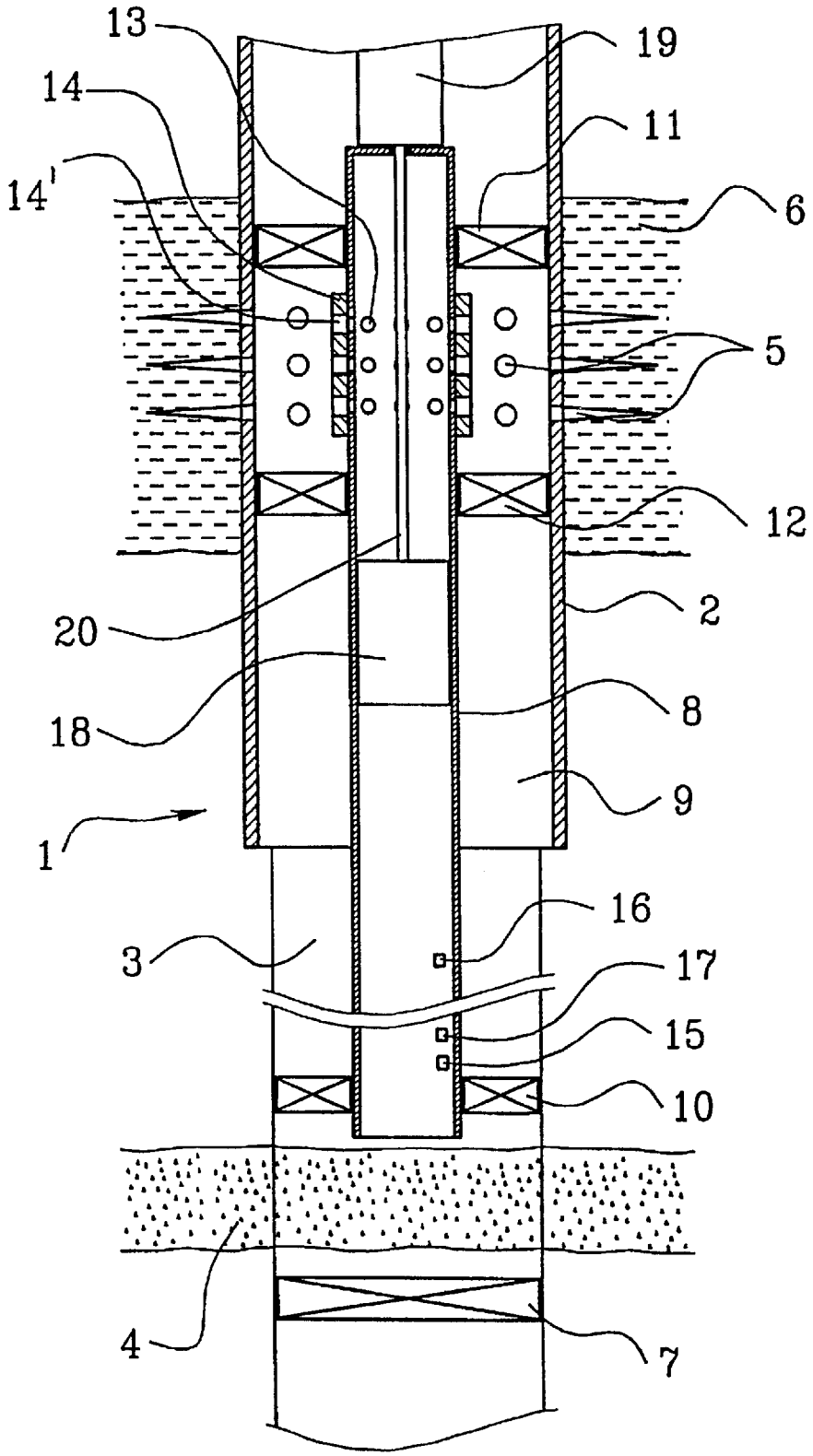
FIG. 2 shows a part of a well having a channel, corresponding to FIG. 1, and where a pump has been disposed.

The channel 8 is closed at the upper end and, according to FIGS. 1 and 2, open at the lower end. In an area distanced from the upper end of the channel 8, below the place where the upper packer 11 is mounted, the channel 8 is provided with gates 13 establishing a fluid communication between the channel 8 and the annulus 9 outside the channel. Thus, fluid may flow from the first formation 4 to the well 1 and into the channel 8 at the lower end thereof, through the channel 8 and out through the gates 13 and further, through the perforations 5, to second formation 6.

In accordance with FIG 1*a*, there is no need here for the perforations 5 in FIGS. 1 and 2. The annulus packers 11 and 12 will then act against the wall defining the bore hole. The packer 7 can also be a part of the channel-forming pipe 8 when the pipe wall is perforated (21) between the packer 7 and the packer 10.

When the annulus packer 7 is mounted to the channel-forming pipe 8, the latter may be closed at the lower end thereof which, according to FIG 1*a*, is positioned below the first, expected permeable formation layer 4. In an area above the annulus packer 7, the channel-forming pipe 8 is, thus, provided with through-going lateral gates 21 which, together with the through-going lateral gates 13, establish fluid communication between the formations 4, 6.

In the channel 8, a remotely operable valve (not shown) is disposed, said valve being adapted to control a fluid flow through the channel 8. The valve may, as known per se, comprise a remotely operated displaceable, perforated sleeve 14 adapted to cover the gates 13, wholly or in part, the radially directed holes 14' of the sleeve 14 being brought to register more or less with the gates 13 or not to register therewith.

Further, in the channel 8, remotely readable sensors are disposed, inclusive a pressure sensor 15 and a flow sensor 16 and a temperature sensor 17. The channel 8 may be assigned a pump 18 adapted to drive a flow of fluid through the channel 8.

The pump can be driven by a motor 19 placed in the extension of the channel 8. As known, a drive shaft 20 between motor 19 and pump 18 is passed pressure-tight through the upper closed end of the channel 8.

Advantageously, the motor 19 may be of a hydraulic type, adapted to be driven by a liquid, e.g. a drilling fluid which, as known, is supplied through a drill string or a coilable tubing, not shown. Also, an electrical motor can be used which can be cooled through the circulation of drilling liquid or through conducting fluid flowing in the channel 8, through a cooling jacket of the motor 19.

In the annulus 9, sensors may be disposed, in order to sense and point out communication or cross flowing to or from the permeable layers, above or below the annulus.

What is claimed is:

1. An apparatus for hydrocarbon production testing, and intended to be mounted in a well having an expected permeable first formation to be production tested, and an expected second penneable formation, said apparatus comprising: one or more sensors, meters, regulators, or controllers for carrying out a corresponding hydrocarbon production sensing, measuring, recording pressure condition or flowing rate determination step relative to hydrocarbon fluid traveling within the well, said apparatus further comprising one or more channel-forming pipes having fluid ports which, within the well, establish a hydrocarbon fluid flow path between the first formation to be production tested and the second permeable formation, and said one or more channel forming pipes being designed to be isolated, testing in use, relative to fluid flow to or from a surface from which the well extends, and at least one seal element provided within the well in order to restrict the fluid flow between the first and second formations to said fluid flow path so as to avoid fluid communication between the two permeable formations other than through said fluid flow path.

2. An apparatus according to claim 1, wherein at least one of said one or more channel-forming pipes is open at an end portion situated closest to the first formation to be production tested to define one of said fluid ports, but closed at the opposite end, and where another portion of said closed end channel-forming pipe is situated adjacent said second formation and has additional fluid ports defined by one or more lateral, through-going gates.

3. An apparatus according to claim 2, further comprising a movable, perforated sleeve which, upon displacement in relation to at least one of said one or more lateral gates provides unthrottled or throttled ingoing/outgoing flow of fluid or closure of the fluid flow.

4. An apparatus according to claim 1, wherein at least one of said one or more channel-forming pipes has opposite, closed end axial end portions respectively positioned adjacent said first and second formations, with each of said closed end axial end portions having lateral, through-going gates defining said fluid ports.

5. An apparatus according to claims 1, further comprising a reversible pump positioned for forced displacement of the fluid between the formations.

6. An apparatus according to claim 1, further comprising a remotely operable valve adapted to control and adjust a fluid flow through at least one of said one or more channel-forming pipes.

7. An apparatus according to claim 1, further comprising a cross flow sensor for sensing if there is any hydrocarbon fluid leakage between the first and second formations that is external to said one or more channel forming pipes and within a well portion extending between said permeable first and second formations.

8. An apparatus according to claim 7 further comprising a fluid leakage sensor which is arranged for detection of leakage of fluid other than a test fluid into said one or more of said channel-forming pipes.

9. The apparatus of claim 8 wherein said fluid leakage sensor is positioned for detection of drilling fluid leakage into said one or more channel-forming pipes.

10. An apparatus according to claim 1 further comprising a fluid leakage sensor for sensing of fluid leakage into said one or more channel forming pipes.

11. The apparatus of claim 10 wherein said fluid leakage sensor is a drilling fluid leakage sensor positioned within said one or more channel-forming pipes.

12. An apparatus according to claim 1 wherein said at least one seal element receives therethrough one or more of said pipes.

13. An apparatus according to claim 12 wherein sealing elements arc axially spaced apart along said one or more pipes between said first and second formations.

14. An apparatus according to claim 10 wherein sealing elements are positioned above and below the one or more fluid ports formed in said one or more pipes at a level in fluid communication with one of said first and second formations.

15. An apparatus according to claim 10 wherein said fluid ports are axially spaced from said at least one seal element.

16. A method for production testing an expected permeable, first formation, using the apparatus of claim 1, comprising:

providing said fluid flow path so as to be in fluid communication with the first permeable formation and the permeable second formation which is expected to be isolated, with respect to fluid cross-flow, from said first permeable formation by an intermediate expected non-permeable formation; conducting a fluid provided by said first formation through said at least one defined fluid flow channel to the permeable second formation such that the second formation receives the fluid and keeps the received fluid at least temporarily; and subjecting the fluid flowing between said first and second formations and along said fluid flow channel to at least one measurement.

17. A method as recited in claim 16 wherein the conducting of fluid from said first formation, through said fluid flow channel and into said second formation is carried out free of a pump.

18. The method according to claim 16, wherein the at least one measurement includes measuring fluid pressure and flow rate.

19. The method according to claim 16, wherein the fluid flow path is defined by having said one or more pipes positioned within a bore hole of the well between the first permeable formation and the second permeable formation, and said method including positioning said at least one seal element within said bore hole to block first and second permeable formation fluid cross-flow within the well and external to said fluid flow channel.

20. The method according to claim 16, comprising a further step of reversing flow of the fluid received by said second formation by conducting the fluid received by the second permeable formation back toward the first permeable formation and measuring fluid flow characteristics of the reverse flow.

21. The method according to claim 16, further comprising a preliminary step of fracturing the first permeable formation.

22. The method according to claim 21, wherein the fracturing is carried out with pressurized liquid introduced through a drill string connected to the fluid flow channel.

23. An apparatus for production testing a permeable formation, comprising:

one or more pipes dimensioned for being positioned within a well such that said one or more pipes define a fluid flow channel or path between a first permeable formation and a second permeable formation;

at least one seal element positioned in the well to isolate the first and second formations from fluid cross-flow; and at least one sensor, in communication with the fluid flow channel, for providing at least one measurement of a fluid conducted in the fluid flow channel from the first permeable formation to the second permeable formation, and wherein said one or more pipes are dimensioned and arranged so as to isolate, relative to an entire axial length of said one or more pipes of said apparatus, fluid flow only between said first and second formations.

24. The apparatus according to claim 23, wherein the sensor is a sensor for use in determining hydrocarbon fluid flow rate and is provided within the fluid flow channel.

25. The apparatus according to claim 23, wherein at least one of said one or more pipes is open at an end of the fluid flow channel closest to the permeable formation to be production tested, and is closed at an opposite end, and wherein said pipe with closed end is provided, in a portion of said pipe adjacent the closed end, with at least one lateral fluid port for fluid communication with the second permeable formation.

26. The apparatus according to claim 23, wherein at least one of said one or more pipes is closed at a first and a second end, and wherein one or more lateral gates for fluid communication are provided adjacent each of the first and second ends within an area of said closed ended pipe which is surrounded by a respective one of the permeable first and second formations.

27. The apparatus according to claim 26, wherein each through-going lateral gate is assigned a movable, perforated sleeve which, upon displacement in relation to a lateral gate in the closed ended pipe provides unthrottled or throttled ingoing/outgoing flow of fluid or closure of the fluid flow.

28. The apparatus according to claim 23, further comprising a pump for displacement of the fluid between the first and the second permeable formations.

29. The apparatus according to claim 28 comprising means for measuring the pump flow in combination with fluid characterization sensors set at locations in contact with a preestablished fluid flow channel volume.

30. The apparatus according to claim 28, wherein the pump is a reversible pump for changing flow direction of the fluid flowing between the first and second formations.

31. The apparatus according to claim 23, wherein the fluid flow channel is provided with a remotely operable valve to control the fluid flow through the channel.

32. The apparatus according to claim 26, further comprising a well casing which, in use, has a free end positioned vertically between said first and second formations, and wherein said one or more pipes retain a position within said casing so as to have a pipe end thereof positioned vertically intermediate said first and second formations.

33. The apparatus according to claim 23, further comprising a well casing which, in use, has a free lower end positioned vertically above both said first and second formations, and wherein said one or more pipes retain a position with respect to said casing so as to penetrate said first and second formations.

34. The apparatus according to claim 23 wherein said at least one seal element is an annular seal element through which one or more of said pipes extends.

35. The apparatus according to claim 33 wherein said one or more pipes include fluid reception ports spaced inwardly of a surface of said well.

36. The apparatus according to claims 35 wherein said at least one seal element is axially spaced in the well from said fluid reception ports.

37. The apparatus according to claim 23 wherein a plurality of seal elements are axially spaced apart within said well, and at least one of said pipes extends through one or more of said seal elements.

38. A hydrocarbon production test method using the apparatus of claim 1 relative to the first permeable formation in fluid communication with said well, said method comprising establishing the fluid flow path between said first permeable formation and the second penneable formation; conducting hydrocarbon fluid flowing out from said first permeable formation, into said well, through said fluid flow path to said permeable second formation which receives the fluid and keeps the fluid at least temporarily; and subjecting the hydrocarbon fluid flowing out from the expected, permeable, first formation, during the production test to pressure measurement and flow rate control.

39. A method according to claim 38, wherein said method includes establishing the fluid flow path with said one or more channel-forming pipes positioned within a bore hole extending between the first and second formations, which formations are situated at different levels and expected not to be in fluid communication with one another absent the bore hole, and said method further comprising providing at least one seal element relative to the bore hole and said one or more channel-forming pipes in order to prevent fluid from flowing from the first formation to the second formation outside said fluid flow path.

40. A method according to claim 39, wherein providing said at least one seal element includes placing a seal element between said first and second formations.

41. A method according to claim 40 wherein providing said at least one seal element further comprises providing a set of seal elements above and below one or more fluid ports formed in said one or more pipes at a level in fluid communication with one of the first and second formations.

42. A method according to claim 38, wherein, after fluid has been transferred from the first formation to the second formation, a reversed production test technique is carried out including forcibly returning previously transferred fluid from the second formation to the first formation.

43. A method according to claim 42, wherein, for a period after measured fluid has been transferred from the first formation to the second formation, the measured fluid is subjected to a reversed production test technique which involves pumping previously transferred and measured fluid from the second formation to the first formation.

44. A method according to claim 38, further comprising fracturing said first formation.

45. A method according to claim 38, wherein establishing said fluid flow path includes providing a pipe having a capped end and a lateral fluid port with a valve for adjusting a level of fluid communication with the second formation.

46. A method according to claim 38 further comprising sensing for fluid cross flow leakage within an annular portion defined by an interior surface of a portion of said well extending between said first and second formations and an external surface of said one or more fluid channel pipes defining said fluid flow path and extending through that well portion.

47. An apparatus for use in testing a hydrocarbon permeable formation, comprising:

a hydrocarbon fluid flow channel-forming pipe having a first end and a second end, said pipe having a first permeable formation fluid communication port at said first end, said pipe further comprising a second permeable formation port at said second end such that all hydrocarbon flow derived form the hydrocarbon permeable formation being tested is controlled and confined within said pipe to travel between the first and second ends of said channel-forming pipe;

means for supporting said apparatus within a well and in position within the well relative to said first and second permeable formations, said supporting means including sealing means positioned so as to preclude cross-flow of hydrocarbon fluid between said first and second permeable formations and both within the well and external to said pipe;

a hydrocarbon fluid physical property sensor positioned to be in communication with the hydrocarbon fluid flow between the first and second permeable formations.

48. The apparatus as recited in claim 47, further comprising a valve supported by said apparatus and positioned to provide flow control relative to the fluid flow between said first and second permeable formations.

49. The apparatus as recited in claim 47 further comprising a first end closure member positioned at the first end of said pipe, said first end closure being positioned so as to block fluid passage axial past said pipe to enhance fluid flow through said second permeable formation fluid communication port and into the second permeable formation when in use; and wherein said closure member is an end cap on said pipe and said apparatus is supported in use solely by said sealing means.

50. The apparatus as recited in claim 47 wherein said sealing means includes a first sealing member and a second sealing member in sealing communication with said pipe and positioned axially spaced along said pipe so as to assume a position above and below the second permeable formation when in use.

51. The apparatus as recited in claim 50 further comprising a third sealing member axially spaced below said first and second seal members.

52. The apparatus as recited in claim 47 wherein said first permeable formation fluid communication port is formed by an open end of said pipe.

53. An apparatus for hydrocarbon production testing, and intended to be mounted in a well having an expected permeable first formation to be production tested, and an expected second permeable formation, said apparatus comprising: one or more sensors, meters, regulators, or controllers for carrying out a corresponding hydrocarbon production sensing, measuring, recording pressure condition or flowing rate determination step relative to hydrocarbon fluid traveling within the well, said apparatus further comprising one or more channel forming pipes each having one or more inlet fluid ports and one or more fluid exit ports which, within the well, establish a hydrocarbon fluid flow path between the first formation to be production tested and the second permeable formation, at least one sealing element placed within the well in order to restrict the fluid flow between the first and second formations to said fluid flow path, and the inlet and outlet fluid ports being located above and below the at least one sealing element and are arranged in said one or more channel forming pipes such that said one or more channel forming pipes represent a closed system which excludes fluid flow to or from additional formations within the well and to or from a surface from which the well extends, such that all fluid flow released to said one or more channel forming pipes by the first permeable formation is restricted to travel to the second formation.

54. An apparatus for testing a well having a first formation and a second formation, the apparatus comprising:

a channel that provides fluid communication between the first formation and the second formation;

a pump in fluid communication with the channel, the pump inducing a flow of fluid from the first formation into the channel and from the channel into the second formation;

at least one sealing element that restricts the flow of fluid; and the channel having one or more inlet ports positioned at a location below or above the at least one sealing clement and one or more outlet ports, and wherein said channel, inlet ports and outlet ports are arranged such that all fluid flow received by said channel between opposite axial ends thereof is directed from the first formation to the second formation in a common flow direction.

55. The apparatus of claim 54, further comprising a pressure sensor.

56. The apparatus of claim 54, further comprising at least one sensor for measuring a characteristic of the fluid.

57. The apparatus of claim 56, wherein that at least one sensor comprises a liquid or gas flow rate sensor.

58. The apparatus of claim 56, wherein the at least one sensor comprises a temperature sensor.

59. The apparatus of claim 36, wherein the at least one sensor comprises a water detection sensor.

60. The apparatus of claim 56, wherein the at least one sensor measures the characteristic of the fluid as the fluid flows from the first formation to the second formation.

61. The apparatus of claim 54 further comprising a sand detection sensor.

62. The apparatus of claim 54 wherein the pump is driven by an electrical submersible motor.

63. The apparatus of claim 54, further comprising a timer and wherein the flow of fluid from the first formation to the second formation is stopped after a certain period of time determined by said timer.

64. The apparatus of claim 54, further comprising a valve that is closable to prohibit the flow of fluid from the first formation to the second formation.

65. The apparatus of claim 64, further comprising at least one sensor for measuring a characteristic of the fluid while the flow of fluid is stopped.

66. The apparatus of claim 65, further comprising pump and valve controls for restarting an earlier stopped flow of fluid so as to enable the fluid flow from the first formation to the second formation.

67. The apparatus of claim 54, wherein the channel has inlet and outlet ports, at least one seal, a pump and one or more measuring devices arranged to correspond with the first formation being located above the second formation.

68. The apparatus of claim 54, wherein the channel has inlet and outlet ports, at least one seal, a pump and measuring devices arranged to correspond with the first formation being located below the second formation.

69. The apparatus of claim 54, further comprising a sensor with a remote read signal output with the output signal being in response to changing flow or pressure conditions in one or any combination of the flow channel, a region between sealing elements and an annulus formed between the well and flow channel.

70. An apparatus for hydrocarbon production testing, and intended to be mounted in a well having an expected permeable first formation to be production tested, and an expected second permeable formation, said apparatus comprising: one or more sensors, meters, regulators, or controllers for carrying out a corresponding hydrocarbon production sensing, measuring, recording pressure condition or flowing rate determination step relative to hydrocarbon fluid traveling within the well, said apparatus further comprising one or more channel-forming pipes having fluid ports which, within the well, establish a hydrocarbon fluid flow path between the first formation to be production tested and the second permeable formation, and at least one seal element provided within the well in order to restrict the fluid flow between the first and second formations to said fluid flow path so as to avoid fluid communication between the two permeable formations other than through said fluid flow path, and wherein at least one of said one or more channel-forming pipes is open at an end portion situated closest to the first formation to be production tested to define one of said fluid ports, but closed at the opposite end, and where another portion of said closed end channel-forming pipe is situated adjacent said second formation and has additional fluid ports defined by one or more lateral, through-going gates.

71. An apparatus for production testing a permeable formation, comprising:

one or more pipes dimensioned for being positioned within a well such that said one or more pipes define a fluid flow channel or path between a first permeable formation and a second permeable formation;

at least one seal element positioned in the well to isolate the first and second formations from fluid cross-flow; and at least one sensor, in communication with the fluid flow channel, for providing at least one measurement of a fluid conducted in the fluid flow channel from the first permeable formation to the second permeable formation, and wherein at least one of said one or more pipes is open at an end of the fluid flow channel closest to the permeable formation to be production tested, and is closed at an opposite end, and wherein said pipe with closed end is provided, in a portion of said pipe adjacent the closed end, with at least one lateral fluid port for fluid communication with the second permeable formation.

72. An apparatus for production testing a permeable formation, comprising:

one or more pipes dimensioned for being positioned within a well such that said one or more pipes define a fluid flow channel or path between a first permeable formation and a second permeable formation;

at least one seal element positioned in the well to isolate the first and second formations from fluid cross-flow; and at least one sensor, in communication with the fluid flow channel, for providing at least one measurement of a fluid conducted in the fluid flow channel from the first permeable formation to the second permeable formation and wherein at least one of said one or more pipes is closed at a first and a second end, arid wherein one or more lateral gates for fluid communication are provided adjacent each of the first and second ends within an area of said closed ended pipe which is surrounded by a respective one of the permeable first and second formations.

73. An apparatus for production testing a permeable formation, comprising:

one or more pipes dimensioned for being positioned within a well such that said one or more pipes define a fluid flow channel or path between a first permeable formation and a second permeable formation;

at least one seal element positioned in the well to isolate the first and second formations from fluid cross-flow;

at least one sensor, in communication with the fluid flow channel, for providing at least one measurement of a fluid conducted in the fluid flow channel from the first permeable formation to the second permeable formation; and a pump for displacement of the fluid between the first and the second permeable formations, and wherein the pump is a reversible pump for changing flow direction of the fluid flowing between the first and second formations.

74. An apparatus for hydrocarbon production testing, and intended to be mounted in a well between an expected permeable first formation to be production tested, and an expected second permeable formation, said apparatus comprising: one or more sensors, meters, regulators, or controllers for carrying out a corresponding hydrocarbon production sensing, measuring, recording pressure condition or flowing rate determination step relative to hydrocarbon fluid traveling within the well, said apparatus further comprising one or more channel-forming pipes having fluid ports which, within the well, establish a hydrocarbon fluid flow path between the first formation to be production tested and the second permeable formation, and sealing means placed within the well in order to restrict the fluid flow between the first and second formation to said fluid flow path so that the fluid flow path constitutes the only fluid communication between the two permeable formations, and said apparatus further comprising a leakage sensor for sensing of fluid leakage including leakage of drilling fluid situated external to said one or more channel-forming pipes into said one or more channel-forming pipes.

* * * * *